US007044230B2

(12) United States Patent
Starr et al.

(10) Patent No.: US 7,044,230 B2
(45) Date of Patent: May 16, 2006

(54) METHOD FOR REMOVING A TOOL FROM A WELL

(75) Inventors: Phillip M. Starr, Duncan, OK (US); Loren C. Swor, Duncan, OK (US); Steven G. Streich, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 116 days.

(21) Appl. No.: 10/765,509

(22) Filed: Jan. 27, 2004

(65) Prior Publication Data

US 2005/0161224 A1 Jul. 28, 2005

(51) Int. Cl.
*E21B 43/27* (2006.01)
*E21B 29/00* (2006.01)

(52) U.S. Cl. ..... 166/376; 166/313; 166/308.1; 166/297

(58) Field of Classification Search ..... 166/191, 166/376, 378, 308.1, 297, 313; 134/3, 22.14
See application file for complete search history.

(56) References Cited

U.S. PATENT DOCUMENTS 2,152,306 A * 3/1939 Grebe et al. ..... 507/272
2,261,292 A * 11/1941 Salnikov ..... 166/291
3,099,318 A * 7/1963 Miller et al. ..... 166/227
4,262,702 A 4/1981 Streich
4,286,629 A 9/1981 Streich et al.
4,432,419 A 2/1984 Streich
4,678,037 A * 7/1987 Smith ..... 166/299
4,688,641 A * 8/1987 Knieriemen ..... 166/387
4,834,184 A 5/1989 Streich et al.
5,224,540 A 7/1993 Streich et al.
5,271,468 A 12/1993 Streich et al.
5,607,017 A 3/1997 Owens et al.
5,709,269 A * 1/1998 Head ..... 166/376
6,095,247 A 8/2000 Streich et al.
6,328,110 B1 * 12/2001 Joubert ..... 166/376
6,397,950 B1 6/2002 Streich et al.
2002/0096365 A1 7/2002 Berscheidt et al.
2003/0168214 A1 9/2003 Sollesnes
2003/0188871 A1 * 10/2003 Dusterhoft et al. ..... 166/308

FOREIGN PATENT DOCUMENTS

WO WO 01/77484 12/2001

OTHER PUBLICATIONS

Foreign Communication from a Related Counterpart Application, Mailing Date Mar. 17, 2005, PCT/GB2005/000166, Filed Jan. 19, 2005.

* cited by examiner

*Primary Examiner*—Kenneth Thompson
(74) *Attorney, Agent, or Firm*—John W. Wustenberg; Haynes & Boone, LLP

(57) ABSTRACT

A method of treating a subterranean formation penetrated by a wellbore, according to which a tool is fabricated of a material that breaks up or dissolves in the presence of a fluid and is inserted in the wellbore for performing a function in the wellbore. The fluid is then introduced to the tool to break up or dissolve portions of the tool and the remaining portions of the tool fall to the bottom of the well.

17 Claims, 4 Drawing Sheets

METHOD FOR REMOVING A TOOL FROM A WELL

BACKGROUND

This disclosure relates to a system and method for treating a subterranean formation penetrated by a wellbore, and, more particularly, to such a system and method for removing downhole tools that are inserted into the wellbore to perform various operations in connection with recovering hydrocarbon fluids from the formation.

Various types of downhole tools are inserted in a well in connection with producing hydrocarbon fluids from the formation surrounding the well. For example, tools for plugging, or sealing, different zones of the formation are often inserted in the wellbore to isolate particular zones in the formation. After the operation is complete, the plugging or sealing tools must be removed from the wellbore which is usually accomplished by inserting a drilling tool into the wellbore and mechanically breaking up the tools by drilling, or the like. However this removal process is expensive and time consuming.

The present invention is directed to a system and method for removing tools from a wellbore that is an improvement over the above techniques.

DETAILED DESCRIPTION

Figure 1:
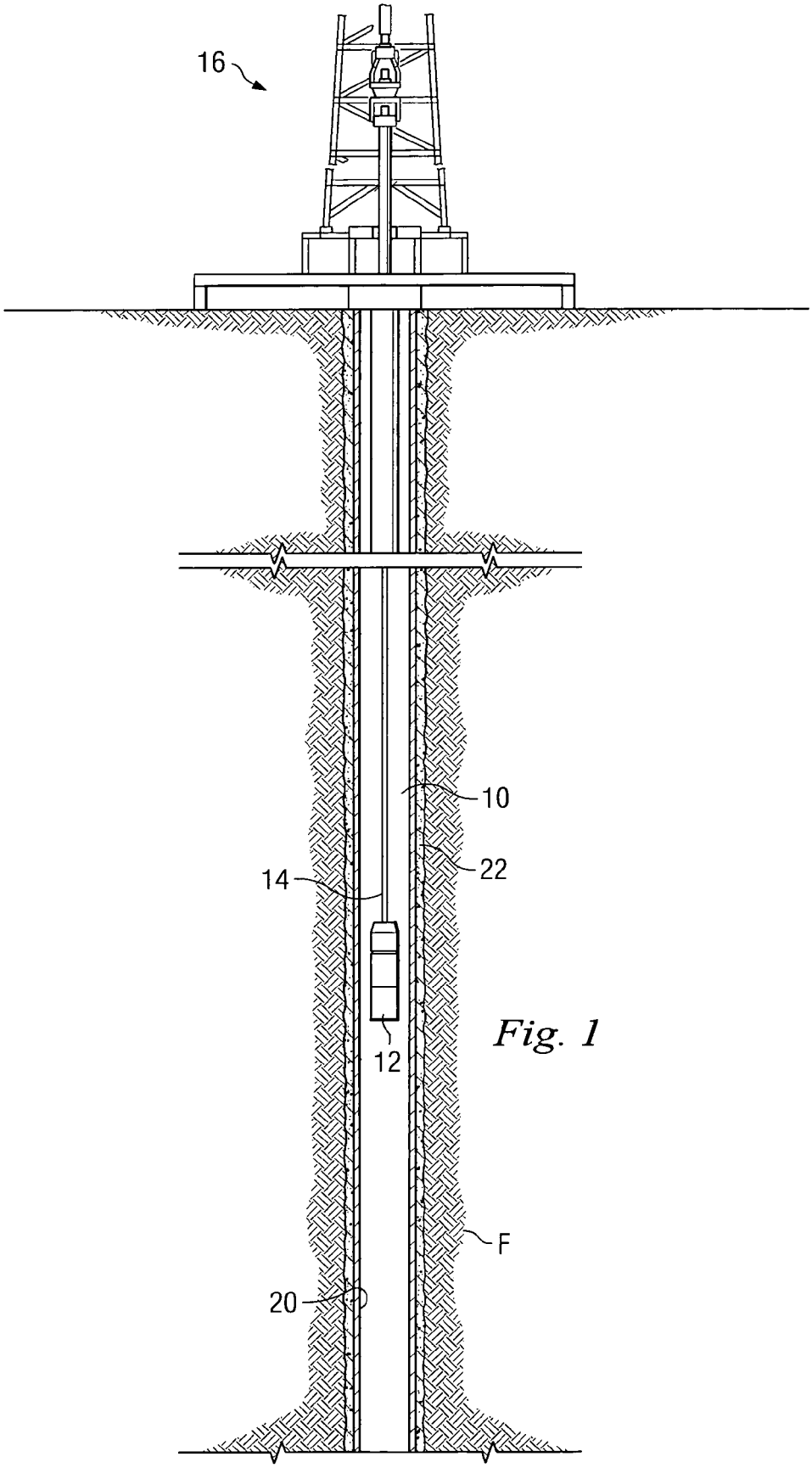
FIG. 1 is an partial elevational/partial sectional view, not necessarily to scale, of a well depicting a system for recovering oil and gas from an underground formation.

Referring to FIG. 1, the reference numeral 10 refers to a wellbore penetrating a subterranean formation F for the purpose of recovering hydrocarbon fluids from the formation F. To this end, and for the purpose of carrying out a specific operation to be described, a tool 12 is lowered into the wellbore 10 to a predetermined depth, by a string 14, in the form of wireline, coiled tubing, jointed tubing, or the like, which is connected to an upper end of the tool 12. The tool 12 is shown generally in FIG. 1 but will be described in detail later. The string 14 extends from a rig 16 that is located above ground and extends over the wellbore 10. The rig 16 is conventional and, as such, includes support structure, a motor driven winch, and other associated equipment for receiving and supporting the tool 12 and lowering it to a predetermined depth in the wellbore 10 by unwinding the string 14 from a reel, or the like, provided on the rig 16.

At least a portion of the wellbore 10 can be lined with a casing 20, and the casing 20 is cemented in the wellbore by introducing cement 22 in an annulus formed between an inner surface of the wellbore 10 and an outer surface of the casing 20, all in a convention manner.

Figure 2:
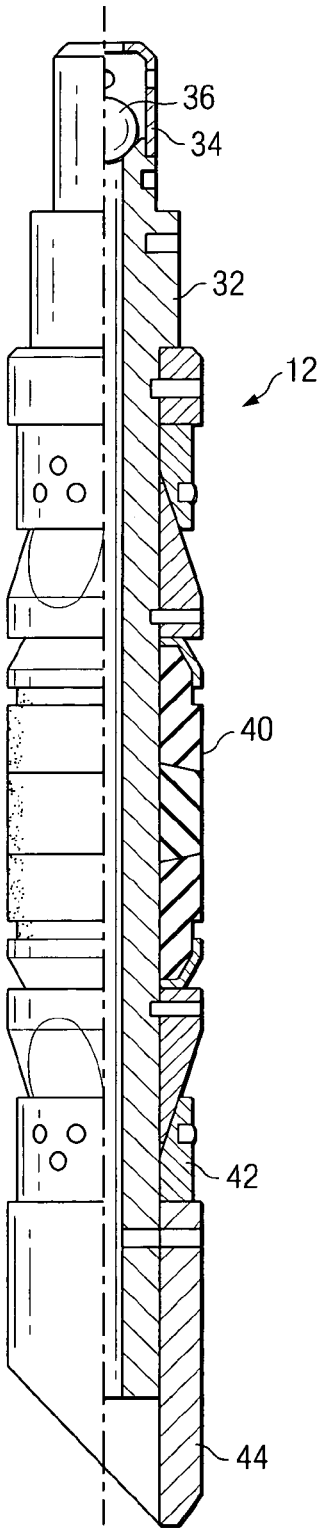
FIG. 2 is a sectional view of a example of a tool that is inserted in the well of FIG. 1 then removed according to an embodiment of the present invention.
Figure 3:
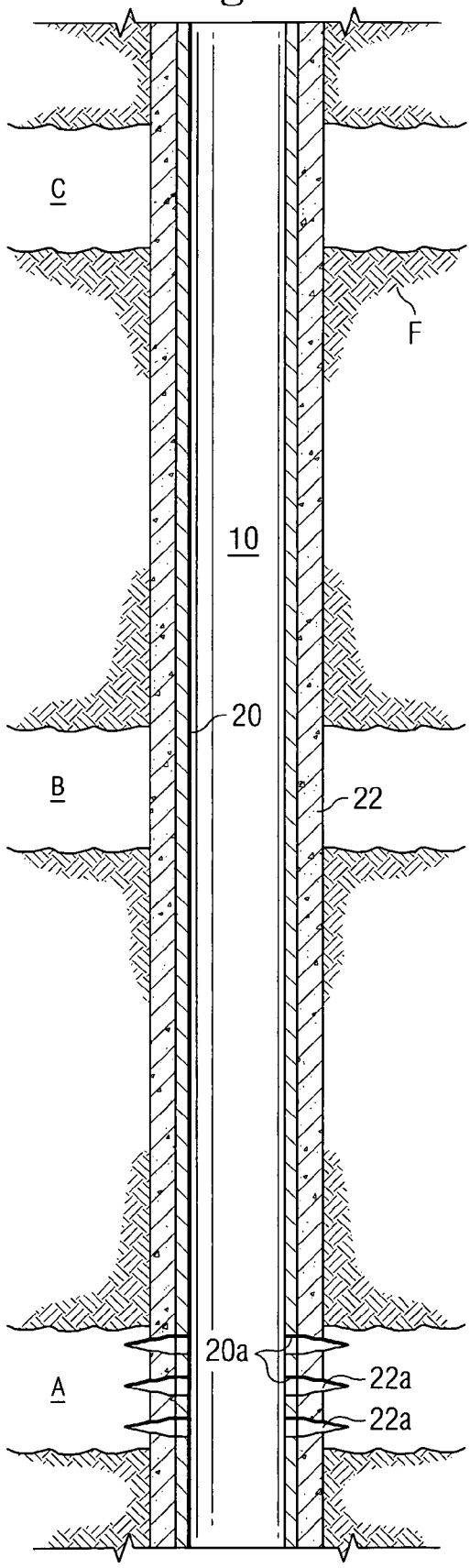
FIGS. 3–6 are enlarged sectional views of the well of FIG. 1 illustrating several steps of inserting and removing the tool of FIG. 2 according to the above embodiment.

For the purpose of example only, it will be assumed that the tool 12 is in the form of a plug that is used in a stimulation/fracturing operation to be described. To this end, and with reference to FIG. 2, the tool 12 includes an elongated tubular body member 32 having a continuous axial bore extending through its length for passing fluids in a manner to be described. A cage 34 is formed at an upper end of the body member 32 for receiving a ball valve 36 which prevents fluid flow downwardly through the body member 32, as viewed in FIG. 1, but permits fluid flow upwardly through the body member 32.

A plurality of angularly spaced packer elements 40 are mounted around the body member 32, and a plurality of angularly spaced slips 42 are mounted around the body member 32 just below the packer elements 40. A tapered shoe 44 is provided at a lower end of the body member 32 for the purpose of guiding and protecting the tool 12 as it is lowered in the wellbore 10.

The above components, as well as most other components making up the tool 12 which are not shown and described above, are fabricated from at least one metal selected from the group consisting of magnesium, aluminum, zinc, iron, tin, and lead or from carbon, with the exceptions of the ball valve 36 and any elastomers utilized in the packer elements 40 or in any other sealing components that may be included in the tool 12. Otherwise, the tool 12 is conventional and therefore will not be described in further detail.

FIGS. 3–6 depict the application of the tool 12 in an operation for recovering hydrocarbon fluids from the formation F. In particular, and referring to FIG. 3, a lower producing zone A, an intermediate producing zone B, and an upper producing zone C, are all formed in the formation F. A plurality of perforations 20*a* and 22*a* are initially made in the casing 20 and the cement 22, respectively, adjacent the zone A. This can be done in a conventional manner, such as by lowering a perforating tool (not shown) into the wellbore 10, performing the perforating operation, and then pulling the tool from the wellbore 10.

The area of the formation F adjacent the perforations 20*a* and 22*a* can then be treated by introducing a conventional stimulation/fracturing fluid into the wellbore 10 such as by pumping, so that it passes through the perforations 20*a* and 22*a* and into the formation F. This stimulation/fracturing fluid can be introduced into the wellbore 10 in any conventional manner, such as by lowering a tool containing discharge nozzles or jets for discharging the fluid at a relatively high pressure, or by passing the stimulation/fracturing fluid from the rig 16 directly into the wellbore 10. In either case, the stimulation/fracturing fluid passes through the perforations 20*a* and 22*a* and into the zone A for stimulating the recovery of production fluids, for example hydrocarbons such as oil and/or gas. The production fluids pass from the zone A, through the perforations 20*a* and 22*a*, and up the wellbore 10 for recovery at the rig 16. If the stimulation/fracturing fluid is discharged through a downhole tool as described above, the latter tool is then removed from the wellbore 10.

Figure 4:
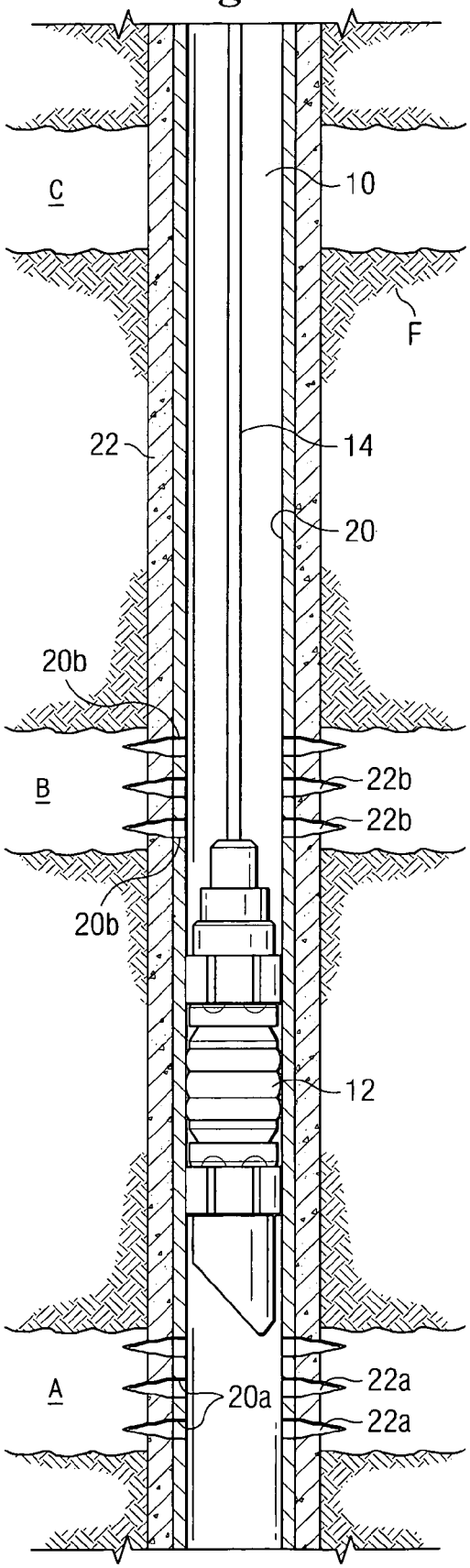

The tool 12 is then lowered by the string 14 into the wellbore 10 to a position where its lower end portion formed by the shoe 44 is just above the perforations 20*a* and 22*a*, as shown in FIG. 4. The slips 42 and the packer elements 40 are set to lock the tool 12 to the casing 20 and to seal the interface between the tool 12 and the casing 20 and thus isolate the zone A. The string 14 is disconnected from the tool 12 and returned to the rig 16. The production fluids from the zone A then pass through the perforations 20*a* and 22*a*, into the wellbore 10 and through the aforementioned bore in the body member 32 of the tool 12, before flowing up the wellbore 10 for recovery at the rig 16.

A second set of perforations 20*b* and 22*b* are then formed, in the manner discussed above, through the casing 20 and the cement 22, respectively, adjacent the zone B just above the upper end of the tool 12. The zone B can then be treated by the stimulation/fracturing fluid, in the manner discussed above, causing the recovered fluids from the zone B to pass from through the perforations 20*b* and 22*b* and into the wellbore 10 where they mix with the recovered fluids from the zone A before flowing up the wellbore 10 for recovery at the ground surface.

Figure 5:
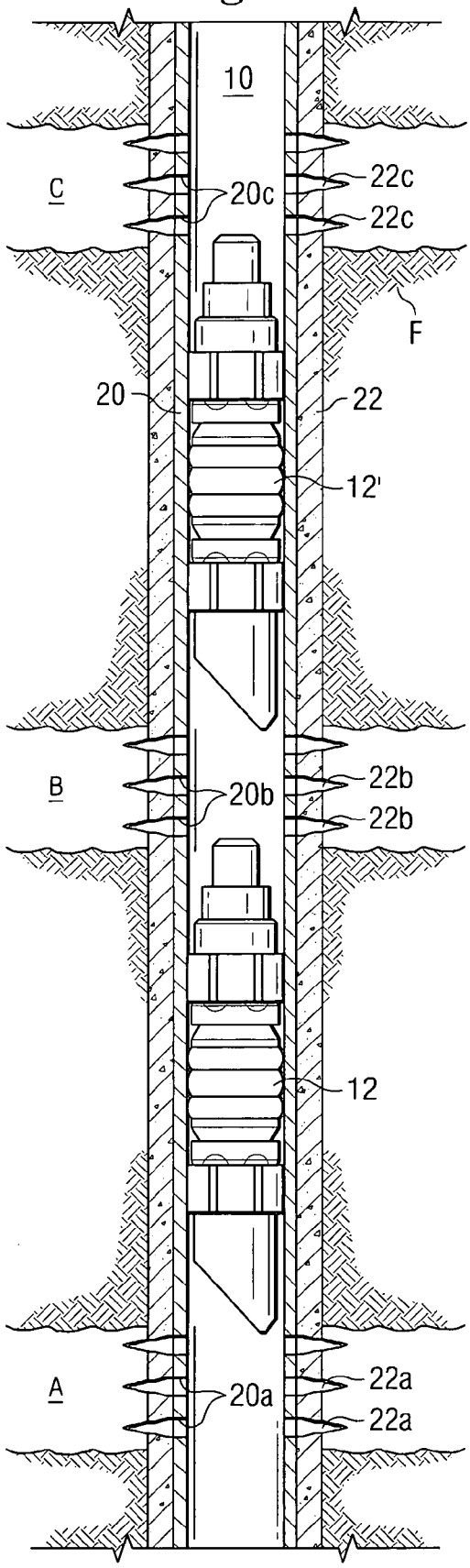

As shown in FIG. 5, another tool 12' is provided, which is identical to the tool 12 and thus includes identical components as the tool 12, which components are given the same reference numerals. The tool 12' is lowered by the string 14 into the wellbore 10 to a position where its lower end portion formed by the shoe 44 is just above the perforations 20*b* and 22*b*. The slips 42 and the packer elements 40 of the tool 12' are set to lock the tool 12' to the casing 20 and to seal the interface between the tool 12' and the casing 20 and thus isolate the zone B. The string 14 is then disconnected from the tool 12' and returned to the rig 16.

A third set of perforations 20*c* and 22*c* are then formed in the casing 20 and the cement 22 adjacent the zone C and just above the upper end of the tool 12', in the manner discussed above. The zone C can then be treated by the stimulation/fracturing fluid, also in the manner discussed above, causing the recovered fluids from the zone C to pass through the perforations 20*c* and 22*c* and into the wellbore 10 where they mix with the recovered fluids from the zones A and B before passing up the wellbore 10 for recovery at the ground surface.

It can be appreciated that additional producing zones, similar to the zones A, B, and C, can be provided above the zone C, in which case the above operations would also be applied to these additional zones.

Figure 6:
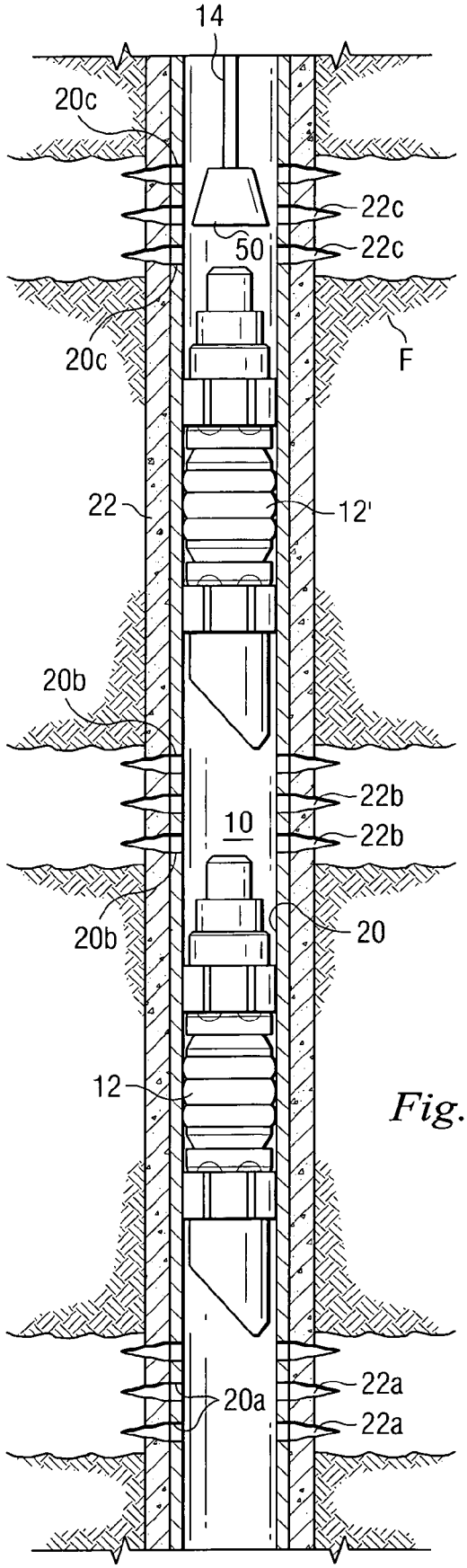

After the above fluid recovery operations are terminated, the tools remaining in the wellbore 10, which in the above example are tools 12 and 12', must be removed from the wellbore 10. To this end, a mineral acid, such as hydrochloric acid or sulfuric acid, is introduced into the wellbore 10 in any conventional manner. For example, as shown in FIG. 6, the string 14 can be formed by coiled tubing and a discharge head 50 is attached to the end of the string 14 and lowered into the wellbore 10 until the discharge head 50 is just above the tool 12'. The mineral acid is introduced into the upper end of the string 14 from a source at the rig 16 and passes through the string 14 before it discharges from the discharge head 50 onto the tool 12'.

As stated above, the tools 12 and 12' are comprised of a metal that chemically reacts with the mineral acid and, in particular, by at least one metal selected from the group consisting of magnesium, aluminum, zinc, iron, tin, and lead or from carbon. The mineral acid is introduced in sufficient quantities so as to react with the metal in a conventional manner to corrode and eventually completely break up or dissolve the metal. This leaves only the components of the tools 12 and 12' not fabricated of the metal, which, in the example above, are the ball valves 36, as well as any elastomers utilized in the packer elements 40 or any other sealing components that may be included in the tool 12'.

After the metal components of the tool 12' are dissolved in the above manner, additional mineral acid from the rig 16 is introduced into the wellbore 10 in the above manner so as to react with the metal components of the tool 12 and dissolve the latter components, as discussed above. It is understood that the string 14, and therefore the discharge head 50, can be lowered as necessary in the wellbore 10 to a position extending just over the tool 12.

The non-metallic components from the tools 12 and 12' could then be pumped or dropped to the bottom of the wellbore 10 into a rat hole, or the like (not shown).

The method of the above embodiment thus permits tools located in a wellbore to be easily and quickly removed with a minimum of expense.

VARIATIONS AND ALTERNATES

The cement 22 can be eliminated.

The type of downhole tool utilized and treated in the above manner can be varied.

The mineral acid introduced to the tools 12 and 12' to break up or dissolve the components of the tools can be a pure mineral acid or a mineral acid based solution.

The type of materials forming the tools as well as the type of acid that breaks up or dissolves the materials can be varied. For example, an organic acid such as formic acid can be used to break up or dissolve the components of the tool.

The mineral acid can be discharged into the wellbore 10 in manners other than that described above.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A method of treating a subterranean formation penetrated by a wellbore, comprising the steps of:

providing a casing in the wellbore;

providing a tool comprising a material that breaks up or dissolves in the presence of an acid;

inserting the tool in the casing for performing a function;

perforating the casing to permit the flow of fluids from the formation, through the perforations, into the wellbore, through the tool, and to the ground surface; and introducing the acid to the tool to break up or dissolve the tool.

2. The method of claim 1 wherein the step of perforating is after the step of inserting and before the step of introducing.

3. The method of claim 1 further comprising the step of pumping a fracturing/stimulation fluid into the wellbore for passing into the formation for promoting the flow of production fluids from the formation.

4. The method of claim 3 where the fracturing/stimulation fluid is pumped into the wellbore after the step of inserting and before the step of introducing.

5. The method of claim 1 wherein the tool comprises carbon.

6. A method of treating a subterranean formation penetrated by a wellbore, comprising the steps of:

providing a tool comprising a material that breaks up or dissolves in the presence of an acid;

inserting the tool at a predetermined location in the wellbore to seal the interface between the tool and the wellbore;

introducing a fracturing/stimulation fluid into the wellbore for passing into the formation for promoting the flow of production fluids from the formation; and introducing the acid to the tool to break up or dissolve the tool.

7. The method of claim 6 wherein the acid comprises a mineral acid.

8. The method of claim 6 wherein the tool comprises at least one metal selected from the group consisting of magnesium, aluminum, zinc, iron, tin, and lead.

9. The method of claim 6 wherein:

the tool comprises a metal; and the acid comprises a mineral acid that reacts with the metal.

10. The method of claim 6 wherein:

at least a portion of the tool comprises at least one metal selected from the group consisting of magnesium, aluminum, zinc, iron, tin, and lead; and the acid comprises a mineral acid that reacts with the metal.

11. The method of claim 10 wherein the metal is magnesium.

12. The method of claim 10 wherein the mineral acid comprises hydrochloric acid.

13. The method of claim 6 further comprising the steps of:

providing a casing in the wellbore; and perforating the casing to permit the flow of fluids from the formation, through the perforations, into the wellbore, through the tool, and to the ground surface.

14. The method of claim 13 wherein the step of perforating is after the step of inserting and before the step of introducing.

15. The method of claim 6 wherein the fracturing/stimulation fluid is introduced above the tool.

16. The method of claim 6 wherein the fracturing/stimulation fluid is introduced into the wellbore after the step of inserting.

17. The method of claim 6 wherein the tool comprises carbon.

* * * * *